United States Patent [19]

Kirchweger et al.

[11] 4,194,484

[45] Mar. 25, 1980

[54] INTERNAL COMBUSTION ENGINE HAVING A NOISE SUPPRESSING ENCAPSULATION

[75] Inventors: Karl Kirchweger; Heinz Fachbach; Gerhard Thien; Josef Greier, all of Graz, Austria

[73] Assignee: Hans List, Graz, Austria

[21] Appl. No.: 858,030

[22] Filed: Dec. 6, 1977

[30] Foreign Application Priority Data

Dec. 10, 1976 [AT] Austria ..... 9171/76

[51] Int. Cl.[2] ..... F02B 77/00; F01P 1/02

[52] U.S. Cl. ..... 123/195 C; 123/198 E; 123/41.7; 181/204; 181/212

[58] Field of Search ..... 123/41.7, 198 E, 195 C; 181/204, 212, 222, 227, 228

[56] References Cited

U.S. PATENT DOCUMENTS

| | | | |
|---|---|---|---|
| 1,311,206 | 7/1919 | Bell | 123/195 C |
| 3,693,602 | 9/1972 | Thien et al. | 181/204 |
| 3,856,439 | 12/1974 | Moehrbach | 181/204 |
| 3,951,114 | 4/1976 | Fachbach et al. | 123/195 C |
| 3,964,462 | 6/1976 | Thien et al. | 123/198 E |
| 4,011,849 | 3/1977 | Latham | 181/204 |
| 4,133,547 | 1/1979 | Fox | 181/204 |
| 4,149,512 | 4/1979 | Hatz | 123/195 C |

FOREIGN PATENT DOCUMENTS

| | | | |
|---|---|---|---|
| 1476642 | 3/1970 | Fed. Rep. of Germany | 123/195 C |
| 2441852 | 10/1975 | Fed. Rep. of Germany | 123/195 C |
| 2547523 | 5/1977 | Fed. Rep. of Germany | 123/195 C |
| 1208482 | 2/1960 | France | 181/204 |

*Primary Examiner*—Ira S. Lazarus
*Assistant Examiner*—Jeffrey L. Yates
*Attorney, Agent, or Firm*—Watson, Cole, Grindle & Watson

[57] ABSTRACT

An internal combustion engine having a noise suppressing encapsulation, said encapsulation being ventilated by a blower and cooling air ducts being formed within the encapsulation by means of partitions, one of said cooling air ducts comprising all fuel and oil leading engine parts and the other cooling air duct being imperviously divided from the first one comprising the parts of the exhaust system.

8 Claims, 5 Drawing Figures

INTERNAL COMBUSTION ENGINE HAVING A NOISE SUPPRESSING ENCAPSULATION

BACKGROUND OF THE INVENTION

The invention relates to an internal combustion engine having a noise-suppressing encapsulation and a blower for ventilation of said encapsulation, cooling air ducts being formed within the encapsulation by means of partitions through which the cooling air flows in two parallel partial streams, one of said cooling air ducts comprising all fuel and oil leading engine parts as injection pump, injection pipes and injection nozzles, crankcase, oil pan, gear case and so on, the other cooling air duct being imperviously divided from the first, comprising the parts of the exhaust system arranged within the encapsulation.

DESCRIPTION OF THE PRIOR ART

At the embodiment according to the prior art the partitions are immediately connected to the walls of the encapsulation and form together with said walls the cooling air ducts. Two partitions are arranged in longitudinal direction of the engine. One of these partitions extends from the exhaust sided upper border-line of the cylinder head to the upper wall of the encapsulation and in longitudinal direction up to the front wall of the encapsulation. The other partition is arranged approximately in line with the jointing plane of cylinder head and crankcase and extends in cross direction to the side wall and in longitudinal direction also up to the front wall of the encapsulation. The first mentioned partition which is immediately adjacent to the engine is penetrated by the exhaust pipes and by the intake pipe connecting the turbo-supercharger with the engine. Hereby it is difficult to prevent air highly heated by the exhaust pipes from unduely heating other engine components as electrical wires, sealings of the encapsulation and so on.

SUMMARY OF THE INVENTION

The disadvantages of the prior art are avoided in that according to the invention the exhaust pipe and the exhaust gas turbine are surrounded by a jacket spaced away from the exhaust pipes and the turbine, one of the partial air streams flowing through the space between said parts of the exhaust system and said jacket, the jacket being secured to the engine leaving gaps in the vicinity of the securing points for the entry of the cooling air, said jacket being made of sheet metal and simultaneously serving as a partition for the separation of said two cooling air streams, said jacket leading the air stream within it separated from the other air stream out of the encapsulation. The described arrangement enables a strict separation of the heated air from the rest of the encapsulation so that any overheating of components within the encapsulation by said heated air is avoided.

According to another embodiment of the invention the jacket is rigidly connected to the encapsulation. This makes a very simple construction possible.

According to a further feature the jacket consists of a first part being secured to the engine and a second part being secured to the encapsulation. It is also possible that the second part of the jacket is a component of the encapsulation. By these means construction and mounting problems caused by more complicated exhaust pipes, particularly with a turbo supercharger in presence, can be avoided. Otherwise high efforts and expenses would be necessary to secure and aligne the jacket in a way to prevent safely the jacket from contacting the engine and transmissing noise in order to avoid any impairment of the noise suppression.

As an advantageous development of the abovementioned construction said two parts of the jacket are spaced apart from each other to allow relative motion, the space between said two parts being sealed by an elastic connecting link. The elastic connecting link may be an asbestos sleeve, a flexible metal pipe, a corrugated tube compensator or similar device. Hereby it is not essential whether the second part of the jacket is arranged within or outside the encapsulation.

In the case the second part of the jacket is projecting far from the encapsulation and securing only to the encapsulation is no more commendable, said second part can be secured to the frame of a vehicle, and according to a further embodiment said second part of the jacket also may be secured to a part of the exhaust pipe, said part of the exhaust pipe being freed from sound conducted through the pipe by means of compensators being interposed in the exhaust pipe line. The sealing of the gap between the second part of the jacket and the outlet of the encapsulation is made in the above mentioned way by means of an elastic connecting link.

DESCRIPTION OF THE DRAWINGS

The invention will be hereinafter more specifically explained with reference to some examplary embodiments depicted in the accompanying drawings, wherein.

DESCRIPTION OF THE PREFERRED EMBODIMENTS

Figure 1:
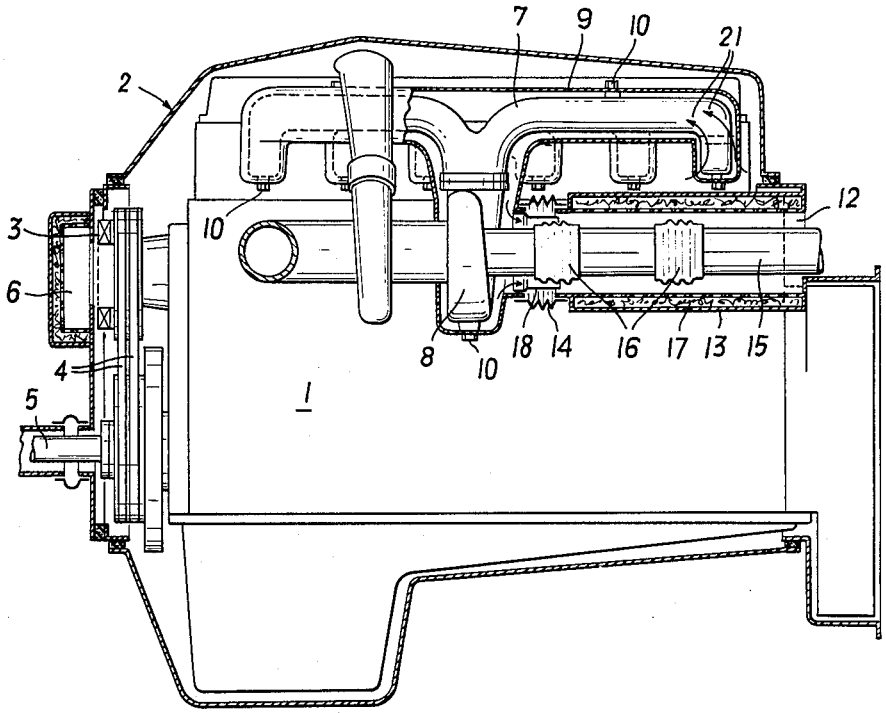
FIG. 1 is an internal combustion engine according to the invention in side view and partial section.

FIG. 1 shows a six cylinder in line engine 1, which is enclosed by a multipart encapsulation 2. The blower 3, driven by V-belt 4 from the shaft 5, ventilates the inside space of the encapsulation with fresh air. The blower 3 draws in the fresh air over the inlet duct 6 which is lined with sound absorbing material, and blows it into two corresponding partial flow streams inside the encapsulation 2. A first partial air flow stream circulates the fresh air within encapsulation 2 and a second partial air flow stream circulates the fresh air around the exhaust system. The exhaust system comprises exhaust manifold 7 and exhaust turbine 8 enclosed by a jacket 9, which is secured immediately to the exhaust manifold 7 or the exhaust gas turbine 8 respectively by means of screws 10. The air drawn by the blower 3 into the second partial air flow stream enters through gaps 11 (FIG. 3) between the exhaust manifold 7 and the jacket 9 which are arranged in the vicinity of the securing points of the exhaust manifold at the engine 1 into the space between the exhaust manifold and the jacket 9 and is further conducted substantially without leakage to the outlet 12. Towards outlet 12 the air flows through the second part of the jacket 13 which follows the first part being spaced apart with its inner end from the first part of the jacket 9. The distance between the two parts of the jacket is bridged by means of an elastic connecting link 14, e.g. an asbestos sleeve, a flexible metal pipe or a corrugated tube compensator. By these means relative motion between both parts 9,13 of the jacket is possible without impairment of the sealing. The exhaust pipe 15 connected to the exhaust gas turbine 8 is equipped with compensators 16 which prevent sound convected by the exhaust pipe 15 from escaping the encapsulation. The elastic connecting link 14 is shielded against the exhaust pipe 15 and heat radiation by means of a ring 18 secured to part 9 of the encapsulation 2.

Figure 3:
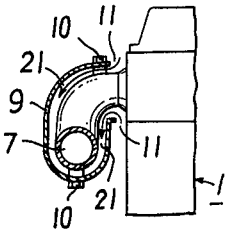
FIG. 3 is a section after line III—III in FIG. 2.
Figure 2:
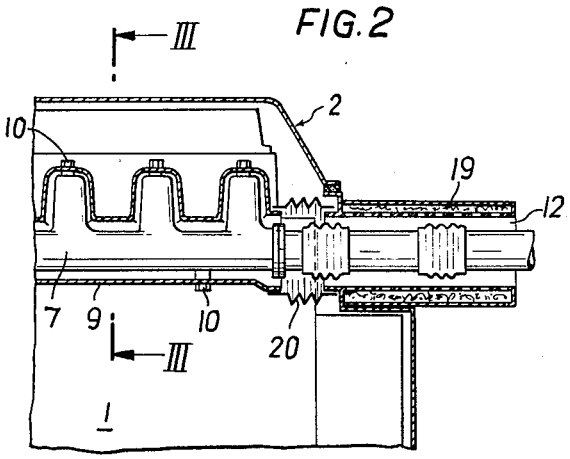
FIG. 2 shows another embodiment of a detail in analogous section.

The embodiment according to FIG. 2 or 3 is distinguished from that depicted in FIG. 1 only by the second part 19 of the jacket which now is arranged outside of the encapsulation 2 yet is secured to it. The axial distance between the parts 9 and 19 of the jacket is also bridged by an elastic connecting link 20. The inflow of air into the jacket space through the gaps 11 is marked in FIG. 3 by arrows 21.

Figure 4:
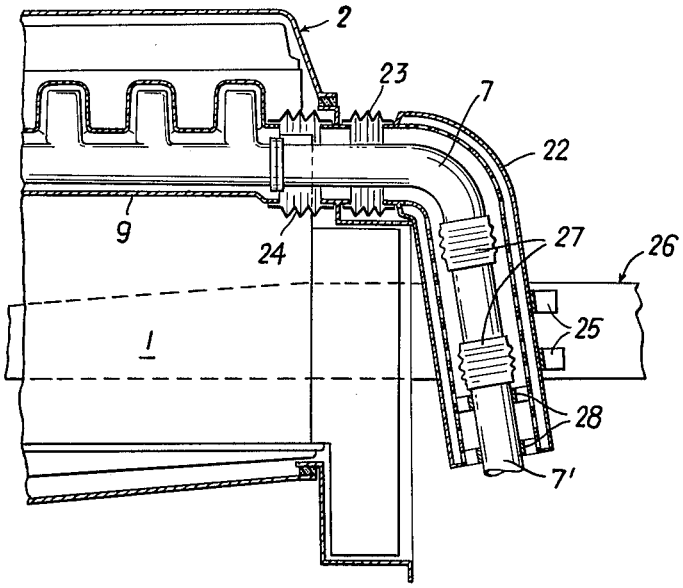
FIG. 4 another embodiment in side view and partial section.

At the embodiment according to FIG. 4 the second part of the jacket 22 is sealed by an elastic sealing member 23 against the encapsulation and the first part of the jacket 9 by an other sealing member. The second part of the jacket 22 which is also lined with sound absorbing material is fixed by means of holders, said holders being attached on their part to the frame 26 of a not shown vehicle. Compensators 27 are interposed into the exhaust pipe to prevent sound conducted by the exhaust pipe from escaping the encapsulation. The second part of the jacket 22 is fixed at the outmost part 7 of the exhaust pipe by means of holders 28.

Figure 5:
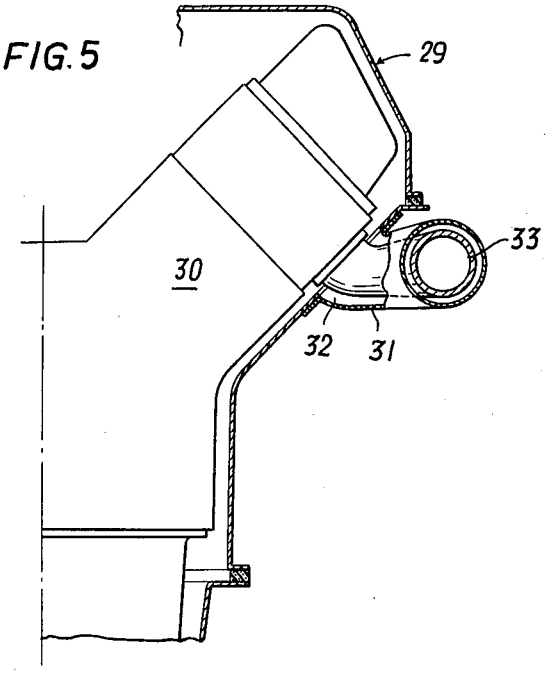
FIG. 5 a further embodiment on a Vee-engine in cross section.

FIG. 5 shows an encapsulation 29 of a Vee-engine. The jacket 31 surrounding the exhaust pipe 33 in this case is immediately secured at the encapsulation 29. The gap 32 between exhaust pipe 33 and jacket 31 enables the inflow of cooling air from the inside space of the encapsulation into the jacket space and also relative motion between the encapsulation 29 and the engine 30.

We claim:

1. An internal combustion engine having an exhaust system, a noise-suppressing encapsulation and a blower for ventilation of said encapsulation, comprising: cooling air ducts being formed within the encapsulation by means of partitions through which the cooling air flows in two partial streams, one of said cooling air ducts forming a first partial air stream enclosing and cooling the engine, the other cooling air duct being imperviously divided from the first, and forming a second partial air stream enclosing and cooling the parts of the exhaust system arranged within the encapsulation including the exhaust pipe and the exhaust manifold all of said exhaust system parts being surrounded by a jacket spaced away from the exhaust pipes, said second partial air stream flowing through a space formed between said parts of the exhaust system and said jacket, the jacket being secured to the engine leaving gaps in the vicinity of the securing points for the entry of the cooling air, said jacket being made of sheet metal and simultaneously serving as a partition for the separation of said two partial air streams, and said jacket leading the air stream within it separated from the other air stream out of the encapsulation.

2. An internal combustion engine according to claim 1, said jacket being rigidly connected to the encapsulation.

3. An internal combustion engine according to claim 1, said jacket including a first part being secured to the engine and a second art being secured to the encapsulation.

4. An internal combustion engine according to claim 1, said jacket including a first part being secured to the engine and a second part being a component of the encapsulation.

5. An internal combustion engine according to claim 3 said two parts of the jacket being spaced apart from each other to allow relative motion, the space between said two parts being sealed by an elastic connecting link.

6. An internal combustion engine according to claim 5 the second part of the jacket projecting from the encapsulation being secured to the frame of a vehicle.

7. An internal combustion engine according to claim 5 the second part of the jacket projecting from the encapsulation being secured to a part of the exhaust pipe, said part of the exhaust pipe being freed from sound conducted through the pipe by means of compensators being interposed in the exhaust pipe line.

8. An internal combustion engine according to claim 1 wherein the exhaust system comprises an exhaust gas turbine enclosed within said jacket.

* * * * *